US006364688B1

(12) United States Patent
Fraley, II et al.

(10) Patent No.: US 6,364,688 B1
(45) Date of Patent: Apr. 2, 2002

(54) THUMBSCREW WITH AUTOMATIC TORQUE-LIMITING FEATURE

(75) Inventors: John Francis Fraley, II; Brian Joseph Stanczyk, both of Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/440,561

(22) Filed: Nov. 17, 1999

(51) Int. Cl.[7] ..... H01R 13/627

(52) U.S. Cl. ..... 439/362; 439/923; 411/7; 411/353

(58) Field of Search ..... 411/6, 7, 402, 411/919, 353; 439/362, 852, 923, 951

(56) References Cited

U.S. PATENT DOCUMENTS 4,512,697 A * 4/1985 Cascini ..... 411/7
5,020,951 A * 6/1991 Smith ..... 411/107
5,449,260 A * 9/1995 Whittle ..... 411/919
5,544,992 A * 8/1996 Ciobanu et al. ..... 411/353
5,586,852 A * 12/1996 Ganter ..... 411/353
5,647,758 A * 7/1997 Ichikawa et al. ..... 439/362
6,079,923 A * 6/2000 Ross et al. ..... 411/7
6,082,941 A * 7/2000 Dupont et al. ..... 411/7

FOREIGN PATENT DOCUMENTS

WO 95/22700 * 8/1995 ..... F16B/31/02

* cited by examiner

*Primary Examiner*—Renee Luebke
*Assistant Examiner*—Briggitte R. Hammond
(74) *Attorney, Agent, or Firm*—Laurence R. Letson

(57) ABSTRACT

A retainer screw for maintaining a retained device such as a cable connector in a connected condition with a host device is provided with a torque disconnecting mechanism that responds to the axial movement of the retainer screw and disconnects the drive of the screw before the screw bottoms in the receiving nut. Disconnecting the drive not only prevents undue torque from being applied to the screw but also prevents seizure of the screw by the nut, preventing easy removal. Also, the disconnecting mechanism continues to provide connection of the drive torque in an unthreading direction notwithstanding the inability of the screw to be driven in the threading direction. The drive member of the retainer screw is allowed to ratchet relative to the screw to relieve the torque.

9 Claims, 4 Drawing Sheets

THUMBSCREW WITH AUTOMATIC TORQUE-LIMITING FEATURE

FIELD OF THE INVENTION

This invention relates to thumbscrews utilized to attach cables and cable connectors and, more specifically, to thumbscrews which limit the torque applied to the screw shaft to prevent damage either to the connector or the device to which the connector is attached.

BACKGROUND OF THE INVENTION

Thumbscrews are commonly incorporated into cable connectors on cables used with personal computers, servers, printers and other electronic devices to retain the connector in a connected, mated condition with the mating device connector.

While thumbscrews are very effective for the described retention function, use of a screwdriver is usually necessary to adequately thread or unthread the screws because the screws are located in cramped quarters. The user may not be able to reach or manipulate the screws with his fingers. Unfortunately, a screwdriver easily permits the application of excessive torque and may cause the screw to "bottom" in the receiving member or nut or cause the receiving member to otherwise break. With an over-torqueing of the thumbscrew by a screwdriver or other tool, it becomes very difficult to remove or unthread a screw without damage to the screw, screw head, the mating nut or female threaded member, possibly rendering the connector unusable or unreliable.

In the event of damage to the connected device, it is many times necessary to remove and replace an electronic expansion circuit board in order to repair the damage. This repair results in delays and significant cost.

OBJECTS OF THE INVENTION

It is an object of the invention to limit torque that may be applied to the retaining thumbscrews of a cable connector by a tool or by the user's fingers.

It is another object of the invention to disconnect the drive of a thumbscrew in one direction of rotation.

It is a further object of the invention to positively drive a thumbscrew in a second direction of rotation even after rotational drive of the thumbscrew has been disconnected in a first direction of rotation.

It is an additional object of the invention to disable the drive between a screw member and its driving member, responsive to the amount of axial displacement of the screw member relative to a member fastened by such screw in a tightening direction of drive.

SUMMARY OF THE INVENTION

A threaded shaft for retaining a connector of a cable or the like is driven by a cup-shaped driving member enclosing one end of the threaded shaft. The enclosed end of the screw shaft and the cup-shaped member form a disengageable drive between the cup-shaped member and the screw shaft; disengagement of this drive is controlled by the progressive engagement of the threads on the threaded screw shaft with a female threaded member or nut and the cup-shaped member being restrained against axial movement by interference with a barrier surface, normally the cable connector housing. As the screw shaft becomes more fully threaded into the female member, the driving surfaces of the cup-shaped member and shaft are disengaged and the cup-shaped member ratchets relative to the driven shaft component and does not further drive the shaft in a threadingly rotational direction.

In an unthreading rotational direction, the drive connection is so configured that, the drive connection is effective to rotate the shaft to unthread the shaft from the female threaded connector even though the drive connection is disconnected or disengaged in the threading rotational direction.

Parts breakage is reduced by simply limiting the torque applied to the shaft. Also, the screw may be unthreaded more easily if the screw is not over-torqued during installation. By preventing the bottoming of the screw threads relative to the female threaded member, the screw is less subject to binding and seizure.

DETAILED DESCRIPTION OF THE BEST MODE

OF THE PREFERRED EMBODIMENT OF THE INVENTION

AS CONTEMPLATED BY THE INVENTORS

Figure 1:
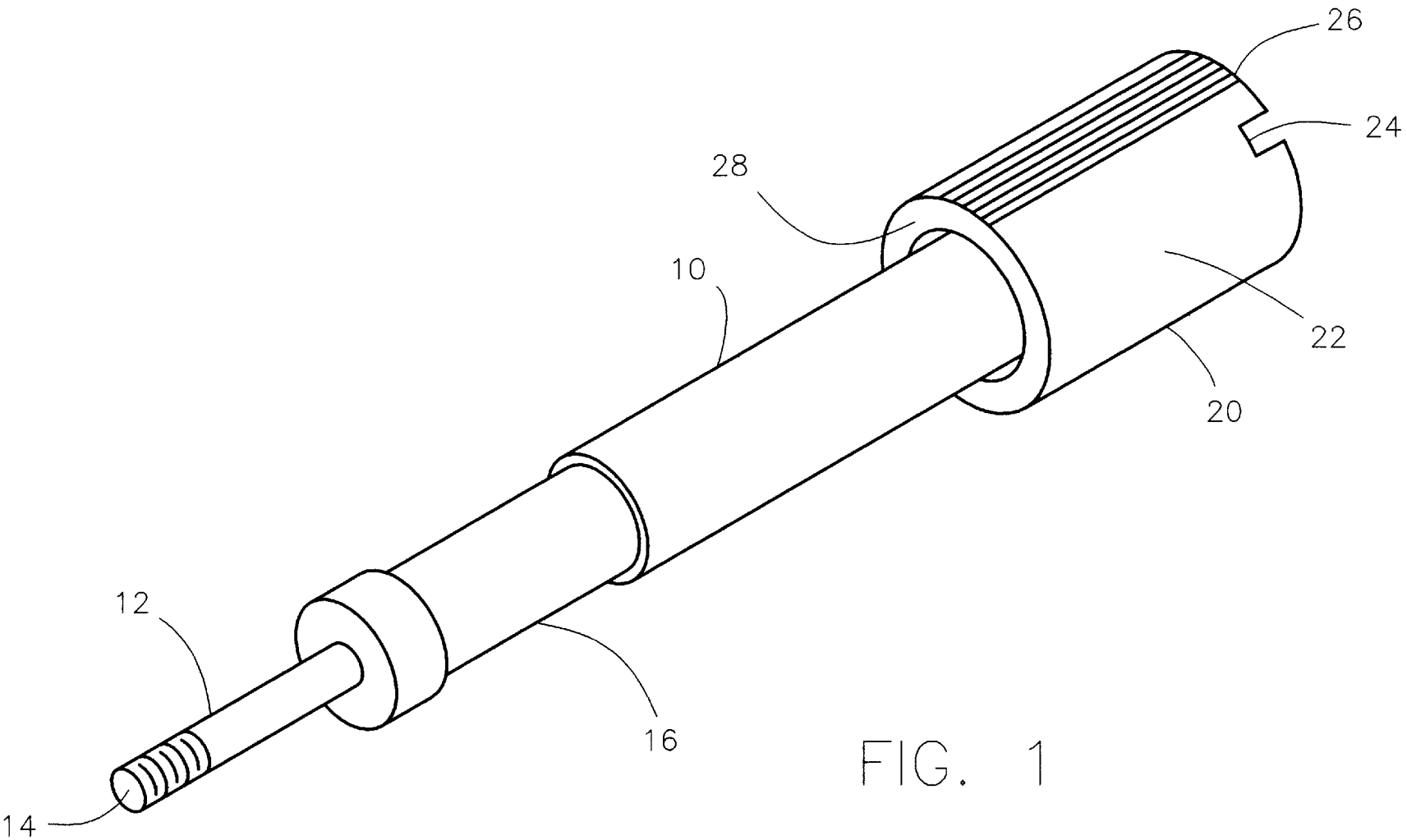
FIG. 1 is a perspective view of an assembled thumbscrew of the invention.

The automatically disengaging, torque-limiting thumbscrew of the invention is initially described with reference to the FIG. 1.

The automatically or self-disengaging torque-limiting thumbscrew 8 is comprised of a shaft 10 with a threaded portion 12 on one end 14, with the threaded portion 12extending along a portion of the length of the shaft 10. The threaded portion 12 may be any desired diameter to engage and mate with a similarly dimensioned female threaded member or nut 30, shown in FIG. 4, for fastening an object associated with the thumbscrew 8, such as a cable connector, to a device with which female threaded member 30 is associated.

One desirable use for this invention is to retain a connector of a cable to a mating connector on a computer or other electronically controlled equipment in order to prevent unintended interruption of the cable connection. Other uses may be envisioned by one of skill in the art.

Further, shaft 10 may be formed with sections 16 of reduced diameter. This reduced diameter section 16 may be engaged by a portion of the device with which the thumbscrew 8 is associated. The reduced diameter section 16 is encircled by a portion of a connector housing 90, as viewable in FIG. 4, and shaft 10 is movable axially relative to the connector housing. The portion of the connector housing 90 encircling the reduced diameter section 16 has a dimension in the axial direction of the thumbscrew 8 which permits the thumbscrew 8 to move axially, threading into the female threaded member 30 or to unthread from the female threaded member 30 to trap or release, respectively, the connector housing 90 relative to the device associated with the female threaded member 30. A portion of the balance of the shaft 10 may be used to loosely engage a passage 84 within connector housing 90 for rotation therein and stability.

The opposite end of shaft 10 is enclosed by a cup-shaped member 20 which is both rotationally and axially movable relative to the shaft 10. Cup-shaped member 20 may have a roughened, ribbed or knurled surface 22 to reduce finger slippage on the surface 22 in the process of threading and unthreading the thumbscrew 8. The internal structure of the cup-shaped member 20 will be described more fully below.

The cup-shaped member 20 is further provided with a groove or slot 24 on the end 26 thereof. The groove 24 is engageable by a flat blade screwdriver to tighten or loosen the thumbscrew 8. Other slot configurations such as cross slots and hex sockets may be used; however, the straight groove 24 is preferred. The axial dimension of the cup-shaped member 20 is sized so that the annular surface 28 is engageable with the connector housing 90 or other device with which thumbscrew 8 is associated as threaded portion 12 is partially threaded into a female threaded member 30. The cup-shaped member 20 is prevented from following the axial movement of the shaft 10 during threading of screw 8, whereby annular surface 28 engages connector housing 90 or other similar device.

Figure 4A:
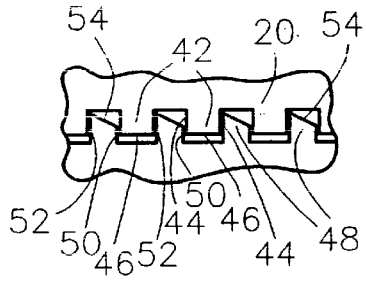
FIG. 4A is an enlarged illustration of the drive connection intermediate the cup-shaped member and the screw, in an assembled condition.
Figure 4:
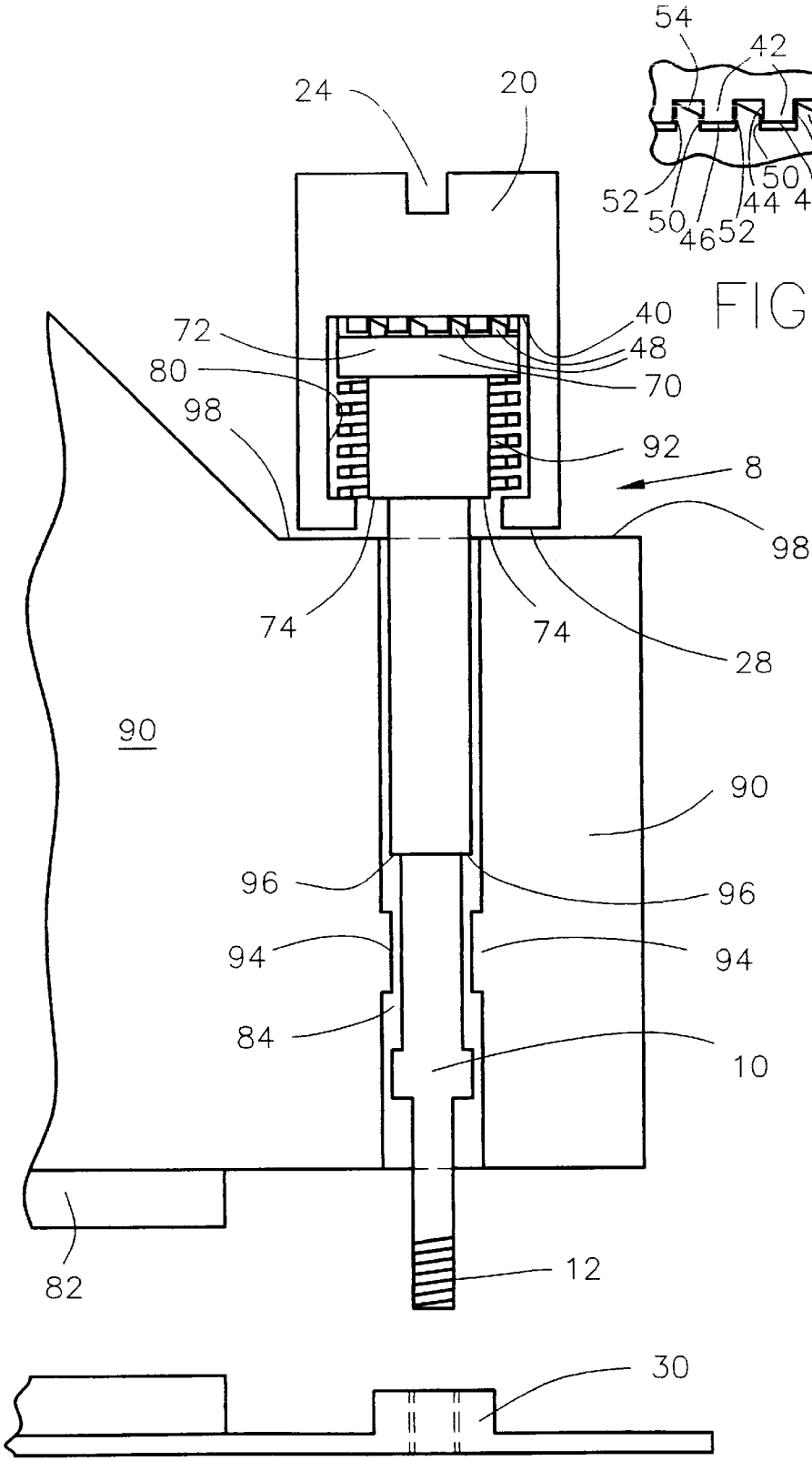
FIG. 4 is an illustration of the torque-limiting thumbscrew of the invention with both a cable connector assembly and a portion of computer connector assembly, shown in a partially broken away condition.

Continued rotation of cup-shaped member 20 and shaft 10 will translate shaft 10 axially away from cup-shaped member 20. This axial displacement will ultimately disengage the drive connection between shaft 10 and cup-shaped member 20 once the axial movement of screw threads 12 is sufficient to securely retain the connector and annular surface 28 engages the connector housing 90. Shaft 10 must move axially an additional distance that equals the height of a driving sidewall surface 50. The drive connection of the thumbscrew 8 is best illustrated in FIG. 4.

Figure 2:
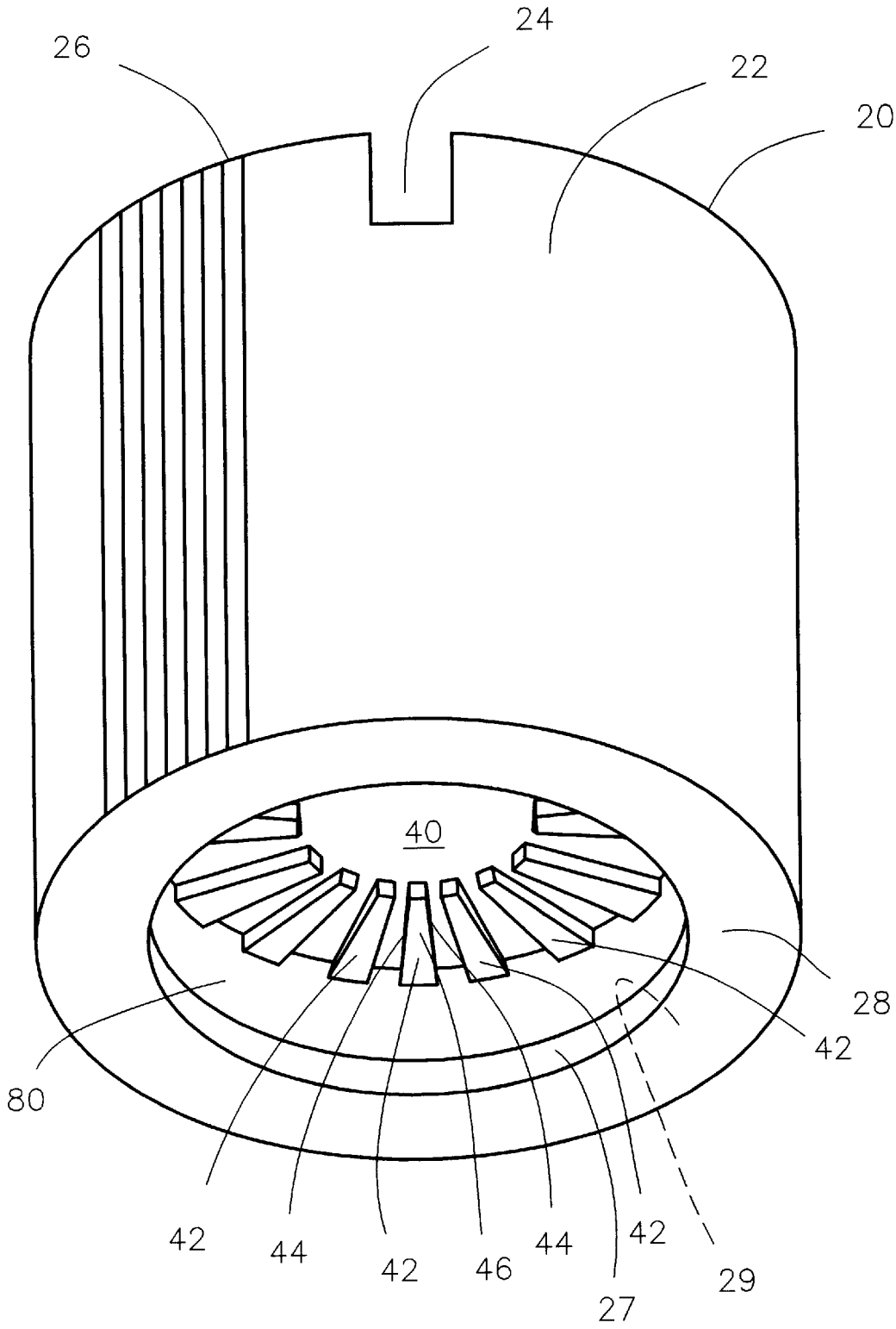
FIG. 2 is a perspective view of a cup-shaped member useful in the invention.

FIG. 2 illustrates the cup-shaped member 20. On the interior end surface 40 of the cup-shaped member 20 are disposed a plurality of truncated wedge-shaped drive lugs 42, each having a pair of side surfaces 44 and a top surface 46 parallel with surface 28. The surfaces 44 and 28 do not necessarily have to be parallel with surface 40 but are preferred in that configuration.

The drive lugs 42 may conveniently be formed by a molding process if the cup-shaped member 20 is made from moldable materials such as plastic.

Figure 3:
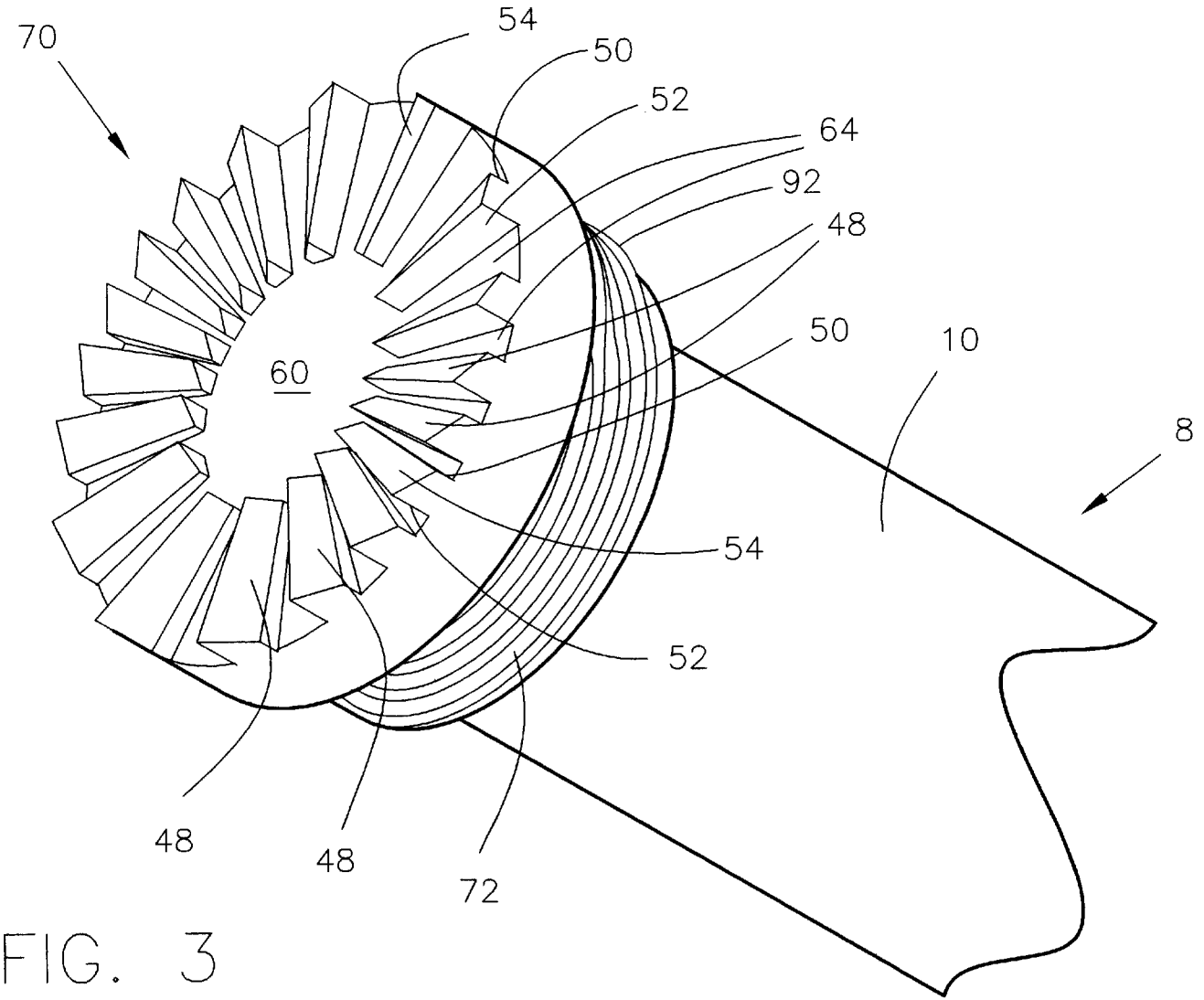
FIG. 3 is a perspective view of a threaded shaft useful in the invention.

The drive lugs 42 of FIG. 2 engage the driven lug members 48 visible in FIG. 3. Cup-shaped member 20 is shown assembled with screw head 72 fully seated over the end 60 of shaft 10 in FIG. 4. The driven lugs 48 are similarly shaped and sized to the driving lugs 42 except that the driven lugs 48 have one radial sidewall 50 shorter than the other sidewall 52.

Driven lugs 48, formed on head 70, have a pair of radial sidewalls 50, 52 and a top wall 54, illustrated in FIG. 3. Sidewalls 50 are shorter sidewalls in the direction of the axis of shaft 10 than sidewalls 52. The top walls 54 extend between the edges of the side walls 50 and 52 and slope relative to the end surface 62 of shaft 10.

The sidewalls 50, 52 and sloping top wall 54 are arranged so that the short sidewalls 50 are on the counter-clockwise side of the driven lug 48 as viewed from that end of thumbscrew 8. The inter-lug gap 64 is dimensioned large enough to admit drive lug 42 of FIG. 2.

Referring to FIG. 3, shaft 10 has an enlarged section 72 around which a coil spring 92 is positioned. The position of coil spring 92, surrounding enlarged shaft portion 72, is also illustrated in FIG. 4.

Cup-shaped member 20 of FIG. 2 is disposed over the end or head 70 of screw 8, as shown in FIG. 4, with drive lugs 42 inserted into gaps 64; the cup-shaped member 20 may be rotated by either fingers or a screwdriver. The spring 92 is disposed around enlarged section 72 of shaft 10 and within cup-shaped member 20 to retain cup-shaped member 20 seated over head 70.

Whenever cup-shaped member 20 is rotated, and lugs 42 and 48 are interdigitated, one of the side walls 44 of lugs 42 will abut and engage either side walls 50 or 52 of the driven lug of 48 and will transfer rotational motion of the cup-shaped member 20 to the thumbscrew 8.

If the cup-shaped member 20 is rotated counter-clockwise to unscrew or unthread the thumbscrew 8, sidewalls 44 of lugs 42 will engage side walls 52 of the driven lugs 48 and thus unscrew or unthread the thumbscrew 8 from the nut or female threaded member 30. On the other hand, if the cup-shaped member 20 is fully seated into engagement with head 70 as viewed in the FIG. 3 and rotated in a clockwise direction, lugs 42 will engage side walls 50 of driven lug 48 causing rotation of lugs 48 and thumbscrew 8 in a screwing or threading direction for a right hand screw thread on shaft 10.

Still referring to FIG. 4, the cup-shaped member 20 is normally urged into engagement with head 70 by a spring 92 encircling shaft 10 of thumbscrew 8. The cup-shaped member 20 is provided with an inwardly extending flange 27 which forms surface 28.

The interior end surface 29 of flange 27 provides a surface against which spring 92 may be engaged to retain cup-shaped member 20 on the head 70 of thumbscrew 8. Shaft 10 is further provided with an enlarged drive section 72 about which a spring 92 may be positioned. Also, the enlarged drive section 72-is smaller than the inner diameter of radial flange 74 on the shaft side of head 70 against which the spring 92 may engage. The natural tendency of compression coil spring 92 to extend will pull cup-shaped member 20 over head 70 and thus urge lugs 42 and 48 toward each other and once aligned properly will interdigitate lugs 42 and 48.

The spring 92 may be assembled with cup-shaped member 20 and thumbscrew 8 by progressively urging the coils of the spring passed flange 27 on cup-shaped member 20 and allowing the spring 92 to uncoil against the interior wall 80 of the cup-shaped member 20 and can be observed in FIGS. 2 and 4.

Referring again to FIG. 4, the thumbscrew 8 and electrical connector 82 are illustrated in a partially broken-away state and incorporated into a cable connector housing 90. FIG. 4 also shows the drive connection between the cup-shaped member 20 and shaft 10, in its assembled form.

The driving lugs 42 are shown interdigitated between the driven lugs 48. The driving lugs 42 engage the short faces 50 of the driven lugs 48 during tightening of the thumbscrew 8.

As the screw threads 12 are threaded or tightened into threaded female member 30, annular face 28 of cup-shaped member 20 engages a barrier to further movement such as connector housing 90. The action of the screw threads 12 tightening into female threaded member 30 will shift shaft 10 axially, compressing spring 92. Lug 42 will be displaced relatively upward from and will progressively disengage side faces 50 of lugs 48. Once lugs 42 disengage side faces 50, sloping top walls 54 will cause the cup-shaped member 20 to ratchet over head 70 if continued clockwise rotation is imparted to cup-shaped member 20.

The thumbscrew 8 may be unscrewed after the shaft 10 has been disconnected from the drive between cup-shaped member 20 and head'70. Engagement of the sidewalls 52 of lugs 48 and side surfaces 44 of lugs 42, due to the greater height of the sidewalls 52 will be effective, even with flange surface 28 engaged with connector 90 and the threading drive disengaged as described above.

Connector housing 90 is formed with an internal collar 94 which, when formed or assembled to thumbscrew 8 engages the shoulder 96 on shaft 10 of thumbscrew 8 to retain the connector 90 against the device to which is screwed thumbscrew 8.

The result of the engagement of surface 28 on the cup-shaped member 20 against a surface 98 of connector 90 is to limit the extent of the engagement of thumbscrew 8 with a female threaded member 30, thereby preventing bottoming of the thumbscrew 8 and causing an over-torquing condition.

As the screw slot 24 is driven, spring 92 and screwdriver engaging screw slot 24 cause engagement of the drive connection between cup-shaped member 20 and shaft 10. Rotation in a clockwise direction will cause thumbscrew 8 to be increasingly engaged with a female threaded member 30 and be pulled axially away from cup-shaped member 20 once cup-shaped member 20 is engaged with surface 98. Cup-shaped member 20 and annular surface 28, whenever engaged with connector 90, will no longer be axially moveable with the shaft 10. The shaft's axial movement may continue until shaft 10 has moved sufficiently for lug 42 to clear sidewall 50 of lug 48 and ratchet over the sloped top wall 54 limiting further rotation of shaft 10 in a tightening direction.

Reversing the rotation of cup-shaped member 20 will unscrew or unthread the shaft 10 as lugs 42 and 48 still will be capable of engaging in a driving relationship, engaging the side faces 44 of lugs 42 with faces 52 of lug 48 even if the threading or tightening torque has been limited in a threading or screwing direction.

Collar 94 will be engaged by shoulders 96 of shaft 1 0 to retain connector 90 and is relieved upon unscrewing, thereby permitting disconnection of connector 90 from its mating member.

It should be understood that one of skill in the art may make minor changes and alterations in the design of this invention without removing the resulting device from the scope of the attached claims.

We claim:

1. A torque-limiting retainer screw assembly comprising:

a screw formed on a shaft having a portion threaded for engagement with a complementary threaded member said screw further comprising a means for rotating said shaft;

a means for engaging said means for rotating said shaft for rotation of shaft in a first direction;

a means for preventing axial movement of said means for engaging said means for rotating said shaft and progressively translating said means for engaging said means for rotating said shaft relative to said shaft, progressively reducing engagement therebetween and drivingly disengaging said shaft and said means for engaging to prevent further rotation of said shaft after a predetermined amount of axial movement of said shaft relative to said means for engaging;

said means for rotating configured for engaging with said means for rotating said shaft in a second direction, notwithstanding driving disengagement of said means for rotating and said shaft, and whereby said retainer screw assembly may be threaded and tightened into a structure by a predetermined distance, said means for rotating said shaft of said screw is prevented from over tightening said screw and said retainer screw, assembly may be unscrewed from said structure after said means for rotating said shaft is rendered ineffective to further tighten said screw.

2. The torque-limiting retainer screw assembly of claim 1 wherein said means for rotating said screw is a member enclosing said means for engaging and further comprises a means for biasing said means for rotating said shaft into interference with means for engaging with respect to relative rotational movement.

3. The torque-limiting retainer screw assembly of claim 2 wherein said means for engaging comprises a plurality of radially extending members within said means for engaging and said means for rotating said screw comprises a like plurality of radially extending bars disposed on an end face of said screw distal from said threaded portion and spaced circumferentially at any radial distance from an axis coaxial with said shaft by a distance greater than a width of said radially extending bars and said means for rotating said shaft comprise a like plurality of radially extending bars disposed on an end face of said shaft distal from said threaded portion and spaced circumferentially at any radial distance from an axis coaxial with said shaft by a distance greater than a width of said like plurality of radially extending bars, whereby said plurality of bars and said like plurality of bars may interdigitate to drivingly engage said means for engaging and said means for rotating said shaft and may be displaced to disengage said means for engaging and said means for rotating said shaft, and said means for rotating further comprises a tool engageable surface for permitting engagement by a tool surface to cause rotation of said means for rotating.

4. A cable connector and connector retainer assembly comprising:

a connector housing disposed at and terminating a cable;

said connector housing mateable with a complementary connector;

at least a retainer captured by said connector housing, said retainer rotatably and axially displaceable with respect to said connector housing;

said retainer further comprising:

a shaft having a portion threaded for engagement with a complementary threaded member and a means for rotating said shaft;

a means for engaging said means for rotating said shaft for rotation of shaft in a first direction;

a means for preventing axial movement of said means for engaging said means for rotating said shaft and progressively translating said means for engaging said means for rotating said shaft relative to said shaft, progressively reducing engagement therebetween and drivingly disengaging said shaft and said means for engaging to prevent further rotation of said shaft after a predetermined amount of axial movement of said shaft relative to said means for engaging;

said means for rotating configured for engaging with said means for rotating said shaft in a second direction, notwithstanding driving disengagement of said means for rotating and said shaft, and whereby said retainer screw assembly may be threaded and tightened into a structure by a predetermined distance, and the means for rotating said shaft of said screw is prevented from over tightening said screw and said retainer screw assembly may be unscrewed from said structure after said means for rotating said shaft is rendered ineffective to further tighten said screw.

5. The cable connector and connector retainer assembly of claim 4 wherein said means for rotating said shaft is a member enclosing said means for engaging and further comprises a means for biasing said means for rotating said shaft into interference with means for engaging with respect to relative rotational movement.

6. The cable connector and connector retainer assembly of claim 4 wherein said means for rotating said shaft is responsive to axial movement of said shaft relative thereto for drivingly disengaging said means for engaging said means for rotating said shaft from said means for rotating said shaft, said axial movement less than that required to bottom said threaded portion with said complementary threaded member.

7. The cable connector and connector retainer assembly of claim 6 wherein said means for engaging further comprises a surface irregularity for aiding rotation thereof.

8. The cable connector and connector retainer assembly of claim 7 wherein said surface irregularity comprises a tool receiving formation.

9. The cable connector and connector retainer assembly of claim 7 wherein said surface irregularity comprises surface roughening.

* * * * *